US006539357B1

(12) United States Patent
Sinha

(10) Patent No.: US 6,539,357 B1
(45) Date of Patent: Mar. 25, 2003

(54) TECHNIQUE FOR PARAMETRIC CODING OF A SIGNAL CONTAINING INFORMATION

(75) Inventor: Deepen Sinha, Chatham, NJ (US)

(73) Assignee: Agere Systems Inc., Allentown, PA (US)

( * ) Notice: Subject to any disclaimer, the term of this patent is extended or adjusted under 35 U.S.C. 154(b) by 0 days.

(21) Appl. No.: 09/454,026

(22) Filed: Dec. 3, 1999

Related U.S. Application Data

(60) Provisional application No. 60/131,581, filed on Apr. 29, 1999.

(51) Int. Cl.[7] ..... G10L 21/04

(52) U.S. Cl. ..... 704/270.1; 704/205; 704/500

(58) Field of Search ..... 704/270, 270.1, 704/200, 200.1, 216, 228, 203, 205, 500, 501; 381/2, 18, 20

(56) References Cited

U.S. PATENT DOCUMENTS

| | | | | | |
|---|---|---|---|---|---|
| 4,794,465 | A | * | 12/1988 | Van Luyt et al. | 386/100 |
| 5,285,498 | A | * | 2/1994 | Johnston | 704/200.1 |
| 5,323,396 | A | * | 6/1994 | Lokhoff | 470/468 |
| 5,438,623 | A | * | 8/1995 | Begault | 381/17 |
| 5,524,054 | A | * | 6/1996 | Spille | 381/20 |
| 5,632,005 | A | * | 5/1997 | Davis et al. | 381/22 |
| 5,706,396 | A | * | 1/1998 | Schroder et al. | 704/216 |
| 5,796,844 | A | * | 8/1998 | Griesinger | 381/18 |

FOREIGN PATENT DOCUMENTS

EP 0 776 134 A2 5/1997

OTHER PUBLICATIONS

J. Herre et al., "Combined Stereo Coding," 93rd Convention, Audio Engineering Society, Oct. 1–4, 1992.

R. van der Waal et al., "Subband Coding of Stereophonic Digital Audio Signals," *IEEE,* 1991, pp. 3601–3604.

Hendrik Fuchs, "Improving Joint Stereo Audio Coding by Adaptive Inter–Channel Prediction," IEEE Workshop on Applications of Signal Processing to Audio and Acoustics, pp. 39–42, 1993.

* cited by examiner

*Primary Examiner*—Richemond Dorvil
(74) *Attorney, Agent, or Firm*—Ryan, Mason & Lewis, LLP

(57) ABSTRACT

In a communications system, parametric coding in accordance with the invention is implemented to generate a representation of a stereo audio signal, which is composed of a left channel signal (L) and a right channel signal (R). To efficiently utilize transmission bandwidth, such a representation contains (1) information concerning only one of the L and R signals, and (2) parametric information based on which, together with (1), the other signal can be recovered. Because of the design of the parametric coding, the representation advantageously captures localization cues of the stereo audio signal, including intensity and phase characteristics of L and R. As a result, the stereo audio signal recovered from the transmitted representation affords a high stereo quality.

52 Claims, 2 Drawing Sheets

100

105

TECHNIQUE FOR PARAMETRIC CODING OF A SIGNAL CONTAINING INFORMATION

The present application claims the priority of U.S. Provisional Patent Application Ser. No. 60/131,581 filed Apr. 29, 1999 entitled "Multidescriptive Coding For Two Path Satellite Broadcasting."

Field of the Invention

The invention relates to systems and methods for communications of a signal containing information, and more particularly to systems and methods for coding a signal containing, e.g., stereo audio information, to efficiently utilize limited transmission bandwidth.

BACKGROUND OF THE INVENTION

Communications of stereo audio information play an important role in multimedia applications, and Internet applications such as a music-on-demand service, music preview for online compact disk (CD) purchases, etc. To efficiently utilize bandwidth to communicate audio information in general, a perceptual audio coding (PAC) technique has been developed. For details on the PAC technique, one may refer to U.S. Pat. No. 5,285,498 issued Feb. 8, 1994 to Johnston; and U.S. Pat. No. 5,040,217 issued Aug. 13, 1991 to Brandenburg et al., both of which are hereby incorporated by reference. In accordance with such a PAC technique, each of a succession of time domain blocks of an audio signal representing audio information is coded in the frequency domain. Specifically, the frequency domain representation of each block is divided into coder bands, each of which is individually coded, based on psycho-acoustic criteria, in such a way that the audio information is significantly compressed, thereby requiring a smaller number of bits to represent the audio information than would be the case if the audio information were represented in a more simplistic digital format, such as the PCM format.

In prior art, a stereo audio signal including a left channel signal (L) and a right channel signal (R) may be further encoded to realize additional savings in transmission bandwidth. For example, a stereo audio signal may be further encoded in accordance with a well known adaptive mean-side (M-S) formation scheme, where $M=(L+R)/2$ and $S=(L-R)/2$. Such a prior art scheme takes advantage of the correlation between L and R, involves selectively turning on or off the M and S formation in each time domain block of the stereo audio signal for each coderband, and yet ensures meeting certain biaural masking constraints. It should be noted that in the adaptive M-S formation scheme, M provides a monophonic effect of the stereo signal while S adds thereto a stereo separation based on the difference between L and R. As such, the more separate L and R, the more bits are required to represent S. However, in a narrow band transmission, e.g., via a 28.8 kb/sec Internet connection, which is common, an M-S encoded stereo audio signal is undesirably susceptible to aliasing distortion attributed to the limited transmission bandwidth. Alternatively, by sacrificing the S information in favor of the M information in the narrow band transmission, mode distortion is introduced to the received signal, thereby significantly degrading its stereo quality.

Another prior art technique for further encoding a stereo audio signal to save transmission bandwidth is known as the intensity stereo coding. For details on such a coding technique, one may refer to: J. Herre et al., "Combined Stereo Coding," 93rd Convention, Audio Engineering Society, Oct. 1–4, 1992. The intensity stereo coding was developed based on the recognition that the ability of a human auditory system to resolve the exact locations of audio sources of L and R decreases towards high frequencies. Typically, it is used to encode the intensity or magnitude of high frequency components of only one of L and R. However, the resulting encoded information facilitates recovery of the high frequency components of both L and R.

SUMMARY OF THE INVENTION

In accordance with the invention, the representation of a composite signal (e.g., a stereo audio signal) for transmission, which includes a first signal and a second signal (e.g., L and R), contains first information derived from at least the first signal, and second information concerning one or more coefficients resulting from parametric coding of the second signal. The first signal may be recovered based on the first information, and the second signal may be recovered based on the first information and the second information.

Advantageously, because of the coefficients used in the representation of the composite signal in accordance with the inventive parametric coding, the transmission bandwidth is efficiently utilized for communicating the composite signal. In addition, due to the design of the parametric coding, such coefficients describe not only an intensity relation between the first signal and the second signal, but also phase relations therebetween. As a result, the signal quality afforded by the inventive parametric coding is superior to that afforded, e.g., by the intensity stereo coding described above.

DETAILED DESCRIPTION

Figure 1:
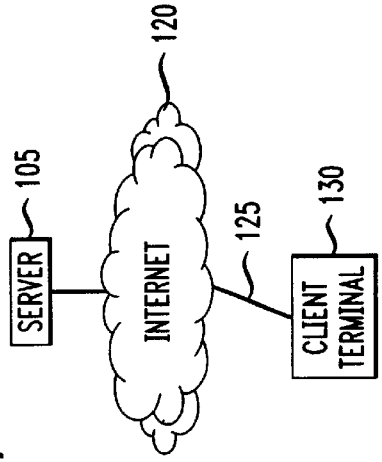
FIG. 1 illustrates an arrangement embodying the principles of the invention for communicating audio information through a communication network.

FIG. 1 illustrates arrangement 100 embodying the principles of the invention for communicating information, e.g., stereo audio information. In this illustrative embodiment, server 105 in arrangement 100 provides a music-on-demand service to client terminals through Internet 120. One such client terminal is numerically denoted 130 which may be a personal computer (PC). As is well known, Internet 120 is a packet switched network for transporting information in packets in accordance with the standard transmission control protocol/Internet protocol (TCP/IP).

Conventional software including browser software, e.g., the NETSCAPE NAVIGATOR® or MICROSOFT EXPLORER® browser is installed in client terminal 130 for communicating information with server 105, which is identified by a predetermined uniform resource locator (URL) on Internet 120. For example, to request the music-on-demand service provided by server 105, a modem (not shown) in client terminal 130 is used to establish communication connection 125 with Internet 120. In this instance, connection 125 affords a 28.8 kb/sec communication rate, which is common. After connection 125 is established, in a conventional manner, client terminal 130 is assigned an IP address for its identification. The user at client terminal 130 may then access the music-on-demand service at the predetermined URL identifying server 105, and request a selected musical piece from the service. Such a request includes the IP address identifying client terminal 130, and information concerning the selected musical piece and communication rate of terminal 130, i.e., 28.8 kb/s in this instance, which affords narrow bandwidth for communication of the musical piece.

In prior art, when a stereo audio signal representing, e.g., a musical piece, is transmitted through a narrow band, which is the case here, the quality of the received signal is invariably degraded significantly due to the limited transmission bandwidth. In accordance with the invention, parametric coding is devised to compress stereo audio information to efficiently utilize the transmission bandwidth, albeit limited, to reduce the degradation of the received signal. In order to fully appreciate the parametric coding described below, characterization of a stereo audio signal, which includes a left channel signal L and a right channel signal R, will now be described.

A stereo audio signal can be characterized using localization cues, which define the location or tilt of the underlying stereo sounds in an auditory space. Of course, some sounds may not be localized, which are perceived as diffuse across a left-to-right span. In any event, the localization cues include (a) low frequency phase cues, (b) intensity cues, and (c) group delay or envelope cues. The low frequency phase cues may be derived from the relative phase of L and R at low frequencies of the signals. Specifically, the phase relationship between their frequency components below 1200 Hz was found to be of particular importance. The intensity cues may be derived from the relative power of L and R at high frequencies of the signals, e.g., above 1200 Hz. The envelope cues may be derived from the relative phase of L and R signal envelopes, and may be determined based on the group delay between the two signals. It should be noted that cues (b) and (c) may be collectively referred to as the "phase cues."

The inventive parametric coding technique is designed to well capture the localization cues of a stereo audio signal for transmission, despite limited available transmission bandwidth. In accordance with the invention, a representation of the stereo audio signal contains (i) information concerning only one of L and R, e.g., L here, and (ii) parametric information concerning the other signal, e.g., R, resulting from parametric coding of R with respect to L. Such a stereo audio signal representation is hereinafter referred to as the "ST representation." In addition, such parametric information concerning R is hereinafter referred to as "param-R." As fully described below, param-R is obtained by quantizing a set of parameters describing the aforementioned localization cues of the stereo audio signal. As a result, R can be predicted based on the param-R and L information, i.e., (i) and (ii). Thus, the stereo audio signal recovered based on the ST representation includes L and a prediction of R, affording an acceptable stereo audio quality, where L is derived from the L information in the ST representation, and the prediction of R is derived from both the param-R and L information therein.

Param-R in the ST representation is obtained based on the following relation:

$$R_f=\alpha L_f, \tag{1}$$

where $R_f$ represents the frequency spectrum of R, $L_f$ represents the frequency spectrum of L, and $\alpha$ represents a predictor coefficient from which param-R is derived. To improve the prediction of $R_f$ based on $L_f$ in (1), multiple predictor coefficients across the frequency range may be used, and hence:

$$R_f^i=\alpha L_f^i, \tag{2}$$

where i represents an index for an $i^{th}$ prediction frequency band in the frequency range. For example, where a perceptual audio coding (PAC) technique is applied to an audio signal, which is the case here and described below, each $i^{th}$ prediction frequency band may coincide with a different one of the coder bands which approximate the well known critical bands of the human auditory system, in accordance with the PAC technique.

Referring to expression (2), the success of predicting $R^i_f$ depends on how well the predictor coefficients, $\alpha^i$, can describe the above-identified localization cues of the stereo audio signal. An enhanced prediction scheme for well describing the intensity cues, and phase cues, i.e., the low-frequency phase cues and envelope cues, will now be described. This scheme relies on imposing some constraints on L and R so that the intensity and phase cue information thereof is available in a single domain to perform the prediction. It is well known in the signal processing theory that if a real signal satisfies a "causality constraint," the real part of the signal spectrum provides a sufficient representation thereof as the imaginary part of the spectrum may be recovered based on the real part without any additional information. Thus, the enhanced prediction scheme in question may be mathematically expressed as follows:

$$R^i_{f\,real\text{-}causal}=\alpha^i L^i_{f\,real\text{-}causal}. \tag{3}$$

Based on expression (3), the aforementioned parametric coding is achieved by computing the predictor coefficients $\alpha^i$ from the real parts of $L^i_f$ and $R^i_f$ after the causality constraints are respectively imposed onto L and R in the time domain, and param-R comprises information concerning $\alpha^i$ for each $i^{th}$ prediction frequency band.

It should be pointed out at this juncture that in practice, the imposition of a causality constraint on L (or R) in the time domain is readily accomplished by zero padding the samples representing L (or R). Thus, in a well known manner, $L^i_{f\,real\text{-}causal}$ (or $R^i_{f\,real\text{-}causal}$) is realized by appending "zeros" to a block of N samples representing L to lengthen the block to (2N-1) samples long, followed by a frequency transform of the zero-padded block and extraction of the real part of the resulting transform, where N is a predetermined number.

For an even more enhanced prediction, a multi-tap predictor may be utilized whereby $\alpha^i$ represents a set of predictor coefficients for an $i^{th}$ prediction frequency band. For example, where a 2-tap predictor is used, $\alpha^i=[\alpha^i_0\alpha^i_1]$ which may be expressed as follows:

$$r=\alpha_0^i l=\alpha_1^i l', \tag{4}$$

where r represents the set of real parts of the frequency components in $R^i_{f\ real\text{-}causal}$ in the $i^{th}$ prediction band, l represents the set of real parts of the frequency components in $L^i_{f\,real\text{-}causal}$ in the $i^{th}$ prediction band, l' represents the set of real parts of the frequency components in $L^i_{f\,real\text{-}causal}$ in the $(i-1)^{th}$ prediction band. As such, the predictor coefficients $\alpha^i_0$ and $\alpha^i_1$ may be determined by solving the following equation:

$$\begin{pmatrix} l^T l & l^T l^t \\ l^T l^t & l^{tT} l^t \end{pmatrix} \begin{pmatrix} \alpha_0^i \\ \alpha_1^i \end{pmatrix} = \begin{pmatrix} l^T r \\ l^{tT} r \end{pmatrix}, \tag{5}$$

where the superscript "T" denotes a standard matrix transposition operation. Thus, $$\begin{pmatrix} \alpha_0^i \\ \alpha_1^i \end{pmatrix} = G^{-1} H, \tag{6}$$

where $$G = \begin{pmatrix} l^T l & l^T l^t \\ l^T l^t & l^{tT} l^t \end{pmatrix};$$

$$H = \begin{pmatrix} l^T r \\ l^{tT} r \end{pmatrix};$$

and the superscript "−1" denotes a standard matrix inverse operation.

In this illustrative embodiment, param-R in the ST representation comprises information concerning predictor coefficients $\alpha^i_0$ and $\alpha^i_1$ describing the localization cues, i.e., the low frequency phase cues, intensity cues and envelope cues, of the underlying stereo audio signal. As mentioned before, param-R together with the L information in the ST representation is used for predicting R. With the communication rate 28.8 kb/sec affordable by connection 125 in this instance, about 22 kb/sec may be allocated to the transmission of the L information and about 2 kb/sec to the transmission of param-R.

Referring back to equation (6), it can be shown that if L is weak, and thus det G (i.e, determinant of G) has a small value, equation (6) for solving $\alpha^i_0$ and $\alpha^i_1$ would be numerically ill conditioned. As a consequence, use of the resulting $\alpha^i_0$ and $\alpha^i_1$ and thus param-R, to predict R based on L is not viable.

To avoid the numerically ill condition in (6), a second parametric coding technique in accordance with the invention will now be described. According to this second technique, the ST representation contains (i) information concerning L*, and (ii) parametric information concerning R resulting from parametric coding of R with respect to L*, denoted param-R[w.r.t. L*], where, e.g., $$L^* = aL + bR, \tag{7}$$

where a+b=1 and a >>b ≧0.

p It should be noted that the parametric coding technique previously described is merely a special case of the second technique with a =1 and b=0. In any event, the disclosure hereupon is based on the generalized, second parametric coding technique involving L*.

It should also be noted that it may be more advantageous to employ the generalized parametric coding technique especially when the stereo audio signal to be coded includes an extremely strong stereo tilt (i.e., almost completely dominated by either L or R). By controlling the a and b values, the pair L* and R in accordance with the generalized technique exhibits a reduced stereo separation, thereby increasing the "naturalness" of the parametric coding.

Figure 2:
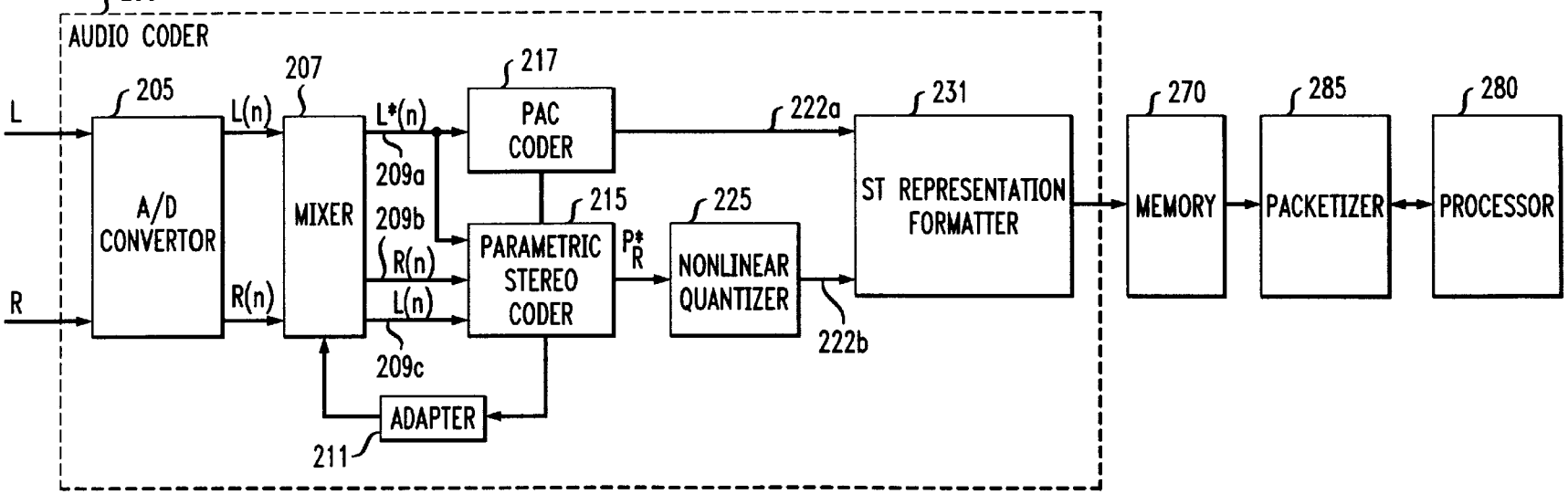
FIG. 2 is a block diagram of a server in the arrangement of FIG. 1.

FIG. 2 illustrates server 105 wherein audio coder 203 is used to process a stereo audio signal representing a musical piece, which consists of L and R. Specifically, analog-to-digital (A/D) convertor 205 in coder 203 digitizes L and R, thereby providing PCM samples of L and R denoted L(n) and R(n), respectively, where n represents an index for an $n^{th}$ sample interval. Based on L(n) and R(n), mixer 207 generates L*(n) on lead 209*a* in accordance with expression (7) above, where values of a and b are adaptively selected by adapter 211 described below. In addition, R(n) and L(n) bypass mixer 207 onto leads 209*b* and 209*c*, respectively. Leads 209*a* –209*c* extend, and thereby provide the respective L*(n), R(n) and L(n), to parametric stereo coder 215 described below. L*(n) is also provided to PAC coder 217.

In a conventional manner, PAC coder 217 divides the PCM samples L*(n) into time domain blocks, and performs a modified discrete cosine transform (MDCT) on each block to provide a frequency domain representation therefor. The resulting MDCT coefficients are grouped according to coder bands for quantization. As mentioned before, these coder bands approximate the well known critical bands of the human auditory system. PAC coder 217 also analyzes the audio signal samples, L*(n), to determine the appropriate level of quantization (i.e., quantization stepsize) for each coder band. This level of quantization is determined based on an assessment of how well the audio signal in a given coder band masks noise. The quantized MDCT coefficients then undergo a conventional Huffman compression process, resulting in a bit stream representing L* on lead 222*a*.

Based on received L*(n) and R(n), parametric stereo coder 215 generates a parametric signal $P^*_R$. $P^*_R$ contains information concerning param-R[w.r.t. L*] which comprises predictor coefficients $\alpha^i_0$ and $\alpha^i_1$ in accordance with equation (6) above, although "l" and "l" therein are derived from L* here, rather than L, pursuant to the generalized parametric coding technique.

$P^*_R$ is quantized by conventional nonlinear quantizer 225, thereby providing a bit stream representing $P^*_R$ on lead 222*b*. Leads 222*a* and 222*b* extend to ST representation formatter 231 where for each time domain block, the bit stream representing $P^*_R$ on lead 222*b* corresponding to the time domain block is appended to that representing L* on lead 222*a* corresponding to the same time domain block, resulting in the ST representation of the musical piece being processed. The latter is stored in memory 270, along with the ST representations of other musical pieces processed in a similar manner.

The adaptation algorithm implemented by adapter 211 for selecting the values of a and b will now be described. This adaptation algorithm involves finding a smooth estimate of an upcoming value of $a = a_{cur+1}$, which is a function of the current time domain blocks of L(n) and R(n) from coder 215, in accordance with the following iterative process:

$$a_{cur+1} = \gamma \epsilon_{cur} + (1-\gamma) a_{cur}, \tag{9}$$

and $$a_0 = 1,$$

where cur represents an iterative index greater than or equal to zero; γ represents a constant having a value close to one, e.g., γ=0.95 in this instance; and $\epsilon_{cur}$ is defined as follows:

$$\varepsilon_{cur} = 0.5 + 0.5\left|\frac{L(f)\cdot R(f)}{\|L(f)\|\ \|R(f)\|}\right|,$$

where L(f) and R(f) respectively are spectrum representations of the current time domain blocks of L(n) and R(n) in the form of vectors; "·" represents a standard inner product operation; and ||L(f)| and ||R(f)|| represent the magnitudes of L(f) and R(f), respectively.

Since a+b=1 as mentioned before, the value selected by adapter 211 for b simply equals 1-a. It should be noted that alternatively, a and b may be predetermined constant values, thereby obviating the need of adapter 211.

In response to the aforementioned request from client terminal 130 for transmission of the selected musical piece thereto, processor 280 causes packetizer 285 to retrieve from memory 270 the ST representation of the selected musical piece and generate a sequence of packets in accordance with the standard TCP/IP. These packets have information fields jointly containing the ST representation of the selected musical piece. Each packet in the sequence is destined for client terminal 130 as it contains in its header, as a destination address, the IP address of terminal 130 requesting the music-on-demand service.

Figure 3:
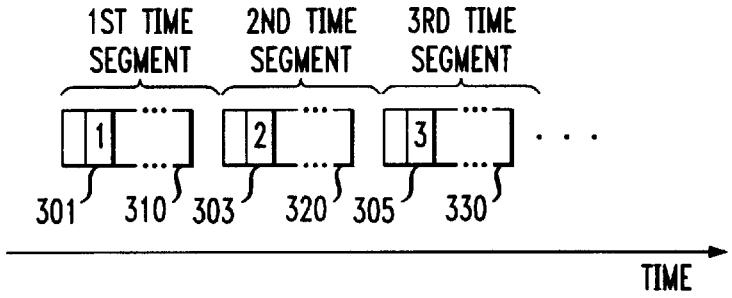
FIG. 3 illustrates a sequence of packets generated by the server of FIG. 2, which contain the audio information.

FIG. 3 illustrates one such packet sequence. To facilitate the assembly of the packets by client terminal 130 when it receives them, the header of each packet contains synchronization information. In particular, the synchronization information in each packet includes a sequence index indicating a time segment i, $1 \leqq i \leqq N$, to which the packet corresponds, where N is the total number of time segments which the selected musical piece comprises. In this illustrative embodiment, each time segment has the same predetermined length. For example, field 301 in the header of packet 310 contains a sequence index "1" indicating that packet 310 corresponds to the first time segment; field 303 in the header of packet 320 contains a sequence index 11211 indicating that packet 320 corresponds to the second time segment; field 305 in the header of packet 430 contains a sequence index "3" indicating that packet 330 corresponds to the third time segment; and so on and so forth.

Figure 4:
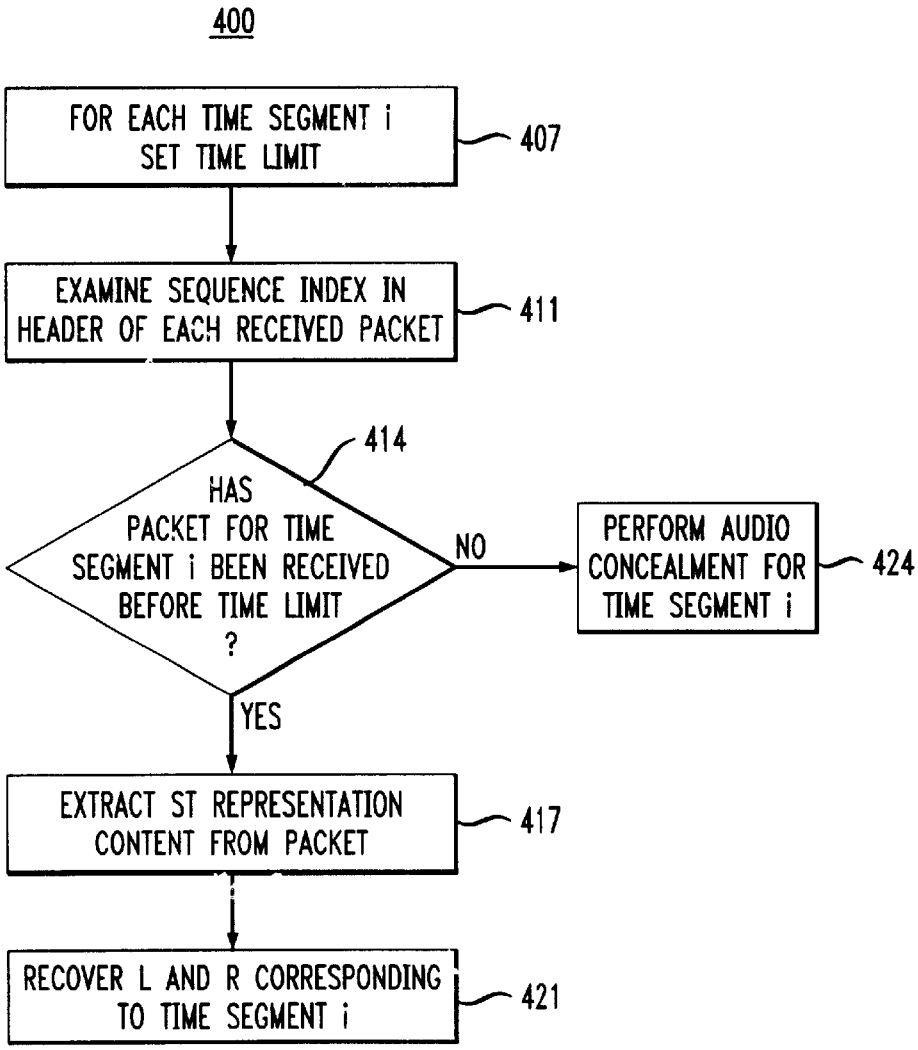
FIG. 4 is a flow chart depicting the steps whereby a client terminal in the arrangement of FIG. 1 processes the packets from the server.

Client terminal 130 processes the packet sequence from server 105 on a time segment by time segment basis, in accordance with a routine which may be realized using software and/or hardware installed in terminal 130. FIG. 4 illustrates such a routine denoted 400. At step 407 of routine 400, for each time segment i, terminal 130 sets a predetermined time limit within which any packet corresponding to the time segment is received for processing. Terminal 130 at step 411 examines the aforementioned sequence index in the header of each received packet. Based on the sequence index values of the received packets, terminal 130 at step 414 determines whether the packet for time segment i has been received before the time limit expires. If the expected packet has been received, routine 400 proceeds to step 417 where terminal 130 extracts the ST representation content from the packet. At step 421, terminal 130 performs on the extracted content the inverse function to audio coder 203 described above to recover the L and R corresponding to time segment i.

Otherwise, if the aforementioned time limit expires before the expected packet is received for time segment i, terminal 130 performs well known error concealment for time segment i, e.g., interpolation based on the results of audio recovery in neighboring time segments, as indicated at step 424.

The foregoing merely illustrates the principles of the invention. It will thus be appreciated that those skilled in the art will be able to devise numerous other arrangements which embody the principles of the invention and are thus within its spirit and scope.

For example, an alternative scheme may be applied to capture the localization cues of a stereo audio signal and effectively represent the signal. This alternative scheme is also based on a prediction in the frequency domain, but works with "real" MDCT representations of the signal, as opposed to the complex DFT representations thereof as before. The MDCT may be viewed as a block transform with a 50% overlap between two consecutive analysis blocks. That is, for a transform block length B, there is a B/2 overlap between the two consecutive blocks. Furthermore, the transform produces B/2 real transform (frequency) outputs. For details on such a transform, one may refer to: H. Malavar, "Lapped Orthogonal Transforms," Prentice Hall, Englewood Cliffs, N.J. The alternative scheme stems from my recognition that the phase cue information of each frequency content, which is not apparent in the real representation, is embedded in the evolution of MDCT coefficients, i.e., the inter-block correlation of a frequency bin in the MDCT representation. Thus, the alternative scheme in which the prediction of, say, a right MDCT coefficient is based on left MDCT coefficients in the same frequency bin for the current as well as previous transform block captures intensity and phase cues for stationary signals. For example, such a prediction may be expressed as follows:

$$R_f^i(k)=\alpha_0^i L_f^i(k) + \alpha_1^i L_f^i(k\text{-}1),$$

where "k" is an index indicating the current MDCT block and "k-1" indicates the previous block. Advantageously, the alternative scheme can be effectively integrated into a PAC codec with a low computational overhead because the required MDCT representation is made available in the codec anyway, and the alternative scheme performs well especially when the stereo audio signal to be coded is relatively stationary.

In addition, the parametric coding schemes disclosed above are illustratively predicated upon a prediction of R based on L. Conversely, the parametric coding schemes may be predicated upon a prediction of L based on R. In that case, the above discussion still follows, with R and L interchanged.

Further, in the disclosed embodiment, the parametric coding technique is illustratively applied to a packet switched communications system. However, the inventive technique is equally applicable to broadcasting systems including hybrid in-band on channel (IBOC) AM systems, hybrid IBOC FM systems, satellite broadcasting systems, Internet radio systems, TV broadcasting systems, etc.

Finally, server 105 is disclosed herein in a form in which various server functions are performed by discrete functional blocks. However, any one or more of these functions could equally well be embodied in an arrangement in which the functions of any one or more of those blocks or indeed, all of the functions thereof, are realized, for example, by one or more appropriately programmed processors.

I claim:

1. Apparatus for processing a signal which includes a first component and a second component thereof, the apparatus comprising:

a processor for deriving one or more coefficients describing at least a phase relation between the first component and the second component; and a controller for generating a representation of the signal, the representation containing first information derived from at least the first component, and second information concerning at least the one or more coefficients, a value of the second component being predictable based on the first information and the second information.

2. The apparatus of claim 1 wherein the signal includes a stereo audio signal.

3. The apparatus of claim 2 wherein the first component includes a left channel signal of the stereo audio signal, and the second component includes a right channel signal thereof.

4. The apparatus of claim 1 wherein the phase relation concerns a phase of at least part of the first component relative to a phase of at least part of the second component.

5. The apparatus of claim 1 wherein the one or more coefficients also describe an intensity of at least part of the first component relative to an intensity of at least part of the second component.

6. The apparatus of claim 1 wherein the one or more coefficients are derived by subjecting the first component and the second component to causality constraints.

7. The apparatus of claim 1 wherein the first information is derived from a combination of the first component and the second component.

8. The apparatus of claim 7 wherein the combination of the first component and the second component is adaptively determined.

9. Apparatus for processing a composite signal which includes a first signal and a second signal, the apparatus comprising:

a mixer for generating a mixed signal based on the first signal and the second signal;

a first coder for coding the mixed signal to generate a representation of the mixed signal;

a second coder responsive to the mixed signal and the first signal for providing information concerning one or more coefficients for predicting the first signal; and a processor for generating a representation of the composite signal, the representation of the composite signal includes the representation of the mixed signal and the information concerning the one or more coefficients.

10. The apparatus of claim 9 wherein the mixed signal is generated in an adaptive manner.

11. The apparatus of claim 9 wherein the composite signal includes a stereo audio signal.

12. The apparatus of claim 11 wherein the mixed signal is coded in accordance with a perceptual audio coding (PAC) technique.

13. The apparatus of claim 11 wherein the first signal includes a left channel signal of the stereo audio signal, and the second signal includes a right channel signal thereof.

14. The apparatus of claim 9 further comprising a controller for packaging the representation of the composite signal in a sequence of packets, each packet including an indicator indicating a sequence order of the packet with respect to other packets.

15. Apparatus for recovering a signal which includes a first component and a second component thereof, the apparatus comprising:

an interface for receiving a representation of the signal, the representation including first information derived from at least the first component, and second information concerning one or more coefficients, which describe at least a phase relation between the first component and the second component; and a processor for recovering the signal based on the representation, the processor predicting a value of the second component based on the first information and the second information in the representation in recovering the signal.

16. The apparatus of claim 15 wherein the representation is packaged in a sequence of packets.

17. The apparatus of claim 16 wherein the signal is recovered on a time-segment basis, each time segment being associated with a different packet in the sequence.

18. The apparatus of claim 17 wherein each packet includes an indicator identifying the time segment with which the packet is associated.

19. The apparatus of claim 18 wherein the processor performs concealment for a time segment in recovering the signal when the packet associated with the time segment is not received within a predetermined period.

20. The apparatus of claim 15 wherein the signal includes a stereo audio signal.

21. The apparatus of claim 20 wherein the first component includes a left channel signal of the stereo audio signal, and the second component includes a right channel signal thereof.

22. The apparatus of claim 15 wherein the phase relation concerns a phase of at least part of the first component relative to a phase of at least part of the second component.

23. The apparatus of claim 15 wherein the one or more coefficients also describe an intensity of at least part of the first component relative to an intensity of at least part of the second component.

24. The apparatus of claim 15 wherein the one or more coefficients are derived by subjecting the first component and the second component to causality constraints.

25. The apparatus of claim 15 wherein the first information is derived from a combination of the first component and the second component.

26. The apparatus of claim 25 wherein the combination of the first component and the second component is adaptively determined.

27. A method for processing a signal which includes a first component and a second component thereof, the method comprising:

deriving one or more coefficients describing at least a phase relation between the first component and the second component; and generating a representation of the signal, the representation containing first information derived from at least the first component, and second information concerning at least the one or more coefficients, a value of the second component being predictable based on the first information and the second information.

28. The method of claim 27 wherein the signal includes a stereo audio signal.

29. The method of claim 28 wherein the first component includes a left channel signal of the stereo audio signal, and the second component includes a right channel signal thereof.

30. The method of claim 27 wherein the phase relation concerns a phase of at least part of the first component relative to a phase of at least part of the second component.

31. The method of claim 27 wherein the one or more coefficients also describe an intensity of at least part of the first component relative to an intensity of at least part of the second component.

32. The method of claim 27 wherein the one or more coefficients are derived by subjecting the first component and the second component to causality constraints.

33. The method of claim 27 wherein the first information is derived from a combination of the first component and the second component.

34. The method of claim 33 wherein the combination of the first component and the second component is adaptively determined.

35. A method for processing a composite signal which includes a first signal and a second signal, the method comprising:

generating a mixed signal based on the first signal and the second signal;

coding the mixed signal to generate a representation of the mixed signal;

in response to the mixed signal and the first signal, providing information concerning one or more coefficients for predicting the first signal; and ° generating a representation of the composite signal, the representation of the composite signal includes the representation of the mixed signal and the information concerning the one or more coefficients.

36. The method of claim 35 wherein the mixed signal is generated in an adaptive manner.

37. The method of claim 35 wherein the composite signal includes a stereo audio signal.

38. The method of claim 37 wherein the mixed signal is coded in accordance with a PAC technique.

39. The method of claim 37 wherein the first signal includes a left channel signal of the stereo audio signal, and the second signal includes a right channel signal thereof.

40. The method of claim 37 further comprising packaging the representation of the composite signal in a sequence of packets, each packet including an indicator indicating a sequence order of the packet with respect to other packets.

41. A method for recovering a signal which includes a first component and a second component thereof, the method comprising:

receiving a representation of the signal, the representation including first information derived from at least the first component, and second information concerning one or more coefficients, which describe at least a phase relation between the first component and the second component;

recovering the signal based on the representation; and predicting a value of the second component based on the first information and the second information in the representation in recovering the signal.

42. The method of claim 41 wherein the representation is packaged in a sequence of packets.

43. The method of claim 42 wherein the signal is recovered on a time-segment basis, each time segment being associated with a different packet in the sequence.

44. The method of claim 43 wherein each packet includes an indicator identifying the time segment with which the packet is associated.

45. The method of claim 44 further comprising performing concealment for a time segment in recovering the signal when the packet associated with the time segment is not received within a predetermined period.

46. The method of claim 41 wherein the signal includes a stereo audio signal.

47. The method of claim 46 wherein the first component includes a left channel signal of the stereo audio signal, and the second component includes a right channel signal thereof.

48. The method of claim 41 wherein the phase relation concerns a phase of at least part of the first component relative to a phase of at least part of the second component.

49. The method of claim 41 wherein the one or more coefficients also describe an intensity of at least part of the first component relative to an intensity of at least part of the second component.

50. The method of claim 41 wherein the one or more coefficients are derived by subjecting the first component and the second component to causality constraints.

51. The method of claim 41 wherein the first information is derived from a combination of the first component and the second component.

52. The method of claim 51 wherein the combination of the first component and the second component is adaptively determined.

* * * * *